US006843535B1

(12) United States Patent
Thomas et al.

(10) Patent No.: US 6,843,535 B1
(45) Date of Patent: Jan. 18, 2005

(54) METHOD OF MILLING DEPRESSIONS AND MACHINE TO PERFORM SAME

(76) Inventors: Glen Edward Thomas, P.O. Box 1083, 1111 Riverside Dr., Moore Haven, FL (US) 33471; Amona Dianne Thomas, P.O. Box 1083, 1111 Riverside Dr., Moore Haven, FL (US) 33471

( * ) Notice: Subject to any disclaimer, the term of this patent is extended or adjusted under 35 U.S.C. 154(b) by 0 days.

(21) Appl. No.: 10/318,574

(22) Filed: Dec. 12, 2002

(51) Int. Cl.[7] ..... E01C 23/09

(52) U.S. Cl. ..... 299/39.4; 299/39.1; 404/93; 404/94

(58) Field of Search ..... 404/93, 94; 299/39.1, 299/39.3, 39.4, 39.6, 40.1

(56) References Cited

U.S. PATENT DOCUMENTS 5,297,894 A * 3/1994 Yenick ..... 404/90
5,484,228 A * 1/1996 Thomas et al. ..... 404/90
5,582,490 A * 12/1996 Murray ..... 404/90
5,607,255 A * 3/1997 Thomas et al. ..... 404/90
5,695,299 A * 12/1997 Thomas et al. ..... 404/94
5,957,620 A * 9/1999 Thomas et al. ..... 404/72
6,210,071 B1 * 4/2001 McSharry ..... 404/94
6,220,783 B1 * 4/2001 Maxwell ..... 404/94
6,454,490 B1 * 9/2002 Murphy ..... 404/94
6,547,484 B2 * 4/2003 Murphy ..... 404/124
2004/0005190 A1 * 1/2004 Jakits ..... 404/75

* cited by examiner

*Primary Examiner*—Sunil Singh

(57) ABSTRACT

A camming surface, having a plurality of camming groups, is moved along, or relative to, the surface of the roadway to regulate installation of depressions. Each camming group is capable of regulating elevation of a rotary cutting tool where the rotary cutting tool may move down and into contact with the surface of the roadway and move up and out of contact with the surface of the roadway. Use of a plurality of sections may be used to cooperate to form the camming surface. Inserts are disclosed for positioning relative to the camming surface to selectively eliminate installation of a depression at a position on the roadway associated with a respective camming group. Use of such inserts allow for installation of skip pattern installations. The ability to move the inserts to any of the camming groups allow for uniform wear of the camming surface following sustained use of the installation machine.

15 Claims, 10 Drawing Sheets

METHOD OF MILLING DEPRESSIONS AND MACHINE TO PERFORM SAME

BACKGROUND

1. Field of the Invention

Generally, the invention relates to machines to install a series of depressions in the surface of a road. More specifically, the invention relates to such machines which utilize a plurality of camming groups, which move in an endless loop, to regulate an elevational movement of a rotary cutting tool.

2. Description of the Prior Art

It has been known for some time that the installation of a series of depressions into a surface of a road adjacent a normal driving lane significantly reduces accidents along the road. This is the result of an operator of a motor vehicle being informed, by the vibration and/or noise created by contact of the tires of the motor vehicle with the depressions, that the motor vehicle has left the normal driving lane.

Generally, the series of depressions, sometimes referred to as 'SNAP' or 'sonic noise alert pattern', will be installed along a defining boundary of the road. These boundaries are along the road adjacent an edge of the normal driving area. For divided highways, where the driving area is designed for unidirectional travel, these boundaries exist on both sides of the road and may have multiple driving lanes therebetween. For bidirectional highways these boundaries exist on the left hand side and optionally, may exist at a center line separating the traffic moving in opposing directions. Similarly, the driving area for each direction of travel may have multiple driving lanes thereon.

The series of depressions may be continuous or may have a skip pattern incorporated therein. Specifications may vary from state to state and even within a particular state. These specifications define overall size and depth of each depression as well as relative placement within the overall series, all within predefined ranges of accuracy.

One example of a set of specifications for a series of depressions, used herein only for illustration, has each depression having a rectangular shape at the surface of the road with a measurement of about sixteen inches across and about seven inches in length aligned with the driving lane. The series will be outside of the normal driving area, but in close proximity thereto. Due to the milling procedure employed, each depression will have an arced base from rearward trailing edge to forward leading edge with a depth of about one half (½) of an inch at the center portion. Numerous specifications require one (1) depression installed for each linear foot of surface. This results in an uncut section of surface between each adjacent pair of depressions of about five inches. Therefore, the continuous series would result in the installation of fifty-two hundred and eighty (5280) depressions per mile. One common configuration for skip pattern installation eliminates four (4) sequential installations within each grouping of twelve (12) continuous series installation. This results in an elimination of one-third (⅓) of the depressions present in the continuous series. Therefore, this skip pattern series would result in the installation of thirty-five hundred and twenty (3520) depressions per mile.

Without regard for the type of installation employed, continuous or skip, certain areas of the road will typically be excluded from the installation procedure. Examples of such areas include along bridges, along intersections, along entrance and exit ramps and sometimes adjacent motorist aid call boxes.

Numerous methods exist to install the series of depressions into the surface of the road. While it is possible to install the depressions using other methods, as exampled by stamping for asphalt, the following examples are specific to rotary cutting tools, as applicable to the present invention.

It has long been known to install the series using a repetitive series of advance, pause, plunge cut cycles utilizing a single cutting tool. This is an extremely inefficient method of installing the series and may result in a series having variation in spacing between each adjacent pair of depressions. For these reasons this type of installation is rarely used today in the industry.

It is known to install the series using a similar pause while utilizing multiple cutting tools. Due to the dimensioning of the individual depressions it is not possible to position adjacent cutting tools in a position to install two (2) adjacent depressions which have the proper spacing therebetween. Therefore, when utilizing such machines having three (3) or more cutting tools it is common to have two (2) separate and distinct advancement cycles. One of the advancement cycles will be equal to the spacing of adjacent depressions within the resultant series. The second will be of a measurement to clear those depressions formed by the prior two (2) installation cycles. This method also is extremely inefficient and may result in a series having variation in spacing between each adjacent pair of depressions. For these reasons this type of installation is rarely used today in the industry.

An innovation over the pause and plunge cut method described above has been to continuously advance the installation machine and the rotary cutting tool while regulating the elevation of the rotary cutting tool to move the rotary cutting tool downward into contact with the surface of the roadway and upward out of contact with the surface of the roadway. Examples of such methods are disclosed in several of applicants seven prior U.S. Patents and the references listed thereunder. The conventional continuous advance method allow for continuous advance of the installation machine with the milling procedure mechanically regulated. It is conventionally known to regulate a lowering action and a raising action of the cutting tool during the advance to provide for the desired spacing between installations as well as the proper dimensioning of the depressions.

Examples of elevational regulation of rotary cutting tools to install a series of depressions include regulatory devices rolling along the surface of the road, such as cam wheels, regulatory devices which are positioned above the surface of the road but rotationally controlled by the speed of the machine, and electronic control devices which measures the advance speed of the machine and control the down and up movement of the rotary cutting tool accordingly. Typically the mechanical regulation machines are less expensive to manufacture and typically provide more precise installations than those machines which rely upon electronic control over the cutting cycles. A deficiency which exist with the mechanical regulation machines involve wear to the regulation surfaces, either those in contact with the surface of the roadway or those which regulate the lowerings and raisings of the rotary cutting tool. Currently when worn beyond acceptable limits replacement of the entire regulatory unit must be made.

Referring now to installation of skip pattern series of depressions, conventional continuous advance installation machines often will utilize a simple mechanical counting method with elimination of the lowering action during the desired gap in the series. An example of the conventional methods of eliminating the lowering action involves either raising the cutting assembly so that the conventional elevation regulation does not reach the surface during the lowering or by otherwise mechanically blocking the cutting assembly in a raised position. A deficiency with some of the known methods of implementing elimination of installations for skip pattern installations with machines capable of continuous installation involve the relatively high speed of installation currently known and the weight of the rotary cutting tool assembly. When a mechanical raising of the rotary cutting tool assembly, such as by hydraulic drive, is implemented often the rotary cutting tool will make at least slight contact with the surface of the roadway at the location of the first skipped cut. While less of a problem, due to the weight of the rotary cutting tool assembly, the first cut after the skipped group may not be fully formed to match the subsequent cuts.

Various deficiencies exist with the conventionally known methods of installing series of depressions. Various attempts have been made to provide for an installation machine capable of installing depressions in a series where precise control over the installation occurs to precisely match the specifications of the particular installation. These attempts have been less efficient than desired. As such, it may be appreciated that there continues to be a need for an installation machine which is versatile and dependable and which may be easily and reliable adjusted to provide for consistent installation of either continuous series of depressions or skip pattern series of depressions. The present invention substantially fulfills these needs.

SUMMARY

In view of the foregoing disadvantages inherent in the known methods of installing depressions into a surface of a road, your applicants have devised a method of installing a series of depressions in a surface of a roadway. The method involves providing a rotary cutting tool, a camming surface, a follower member and linking means then moving the rotary cutting tool along the surface of the roadway. The rotary cutting tool is capable of milling into the surface of the roadway. The camming surface moves in an endless loop in response to movement relative to the surface of the roadway. The camming surface has a plurality of camming groups with each camming group having a surface elevational configuration. The follower member tracks the camming surface where the follower member is elevational displaced corresponding to movement relative to the surface elevational configuration of at least select camming groups of the camming surface. The linking means provides for a transfer of the elevational displacement of the follower member to an elevational displacement of the rotary cutting tool. As the rotary cutting tool moves along the surface of the roadway the elevational displacement of the rotary cutting tool is repetitively performed where the rotary cutting tool is alternatingly displaced downward into contact with the surface of the roadway and displaced upward out of contact with the surface of the roadway to successively install the series of depressions in the surface of the roadway.

Our invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for the use of a camming surface having a plurality of camming groups positioned thereon where the camming surface moves in an endless loop in response to movement relative to the surface of the roadway to regulate a milling action.

Other objects include;

a) to provide for a cam wheel having the camming surface positioned thereon.

b) to provide for a cam track having the camming surface positioned thereon.

c) to provide for the camming surface to be segmented and made up of plurality of sections attached to a cam carrier.

d) to provide for an insert to be positioned relative to select camming groups to selectively eliminate installation of select depressions to produce a skip pattern installation.

e) to provide for the inserts to be removeably installed relative to any desired camming group where rotation of the placement locations may occur for uniform wear of the camming surface during sustained usage.

f) to provide for a camming surface having twelve camming groups positioned thereon wherein a skip pattern having eight installations and four skipped installation positions may readily be installed.

g) to provide for secondary blocking means to mechanically elevate the rotary cutting tool during passage through the camming groups associated with the skipped installation positions of a skip pattern installation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
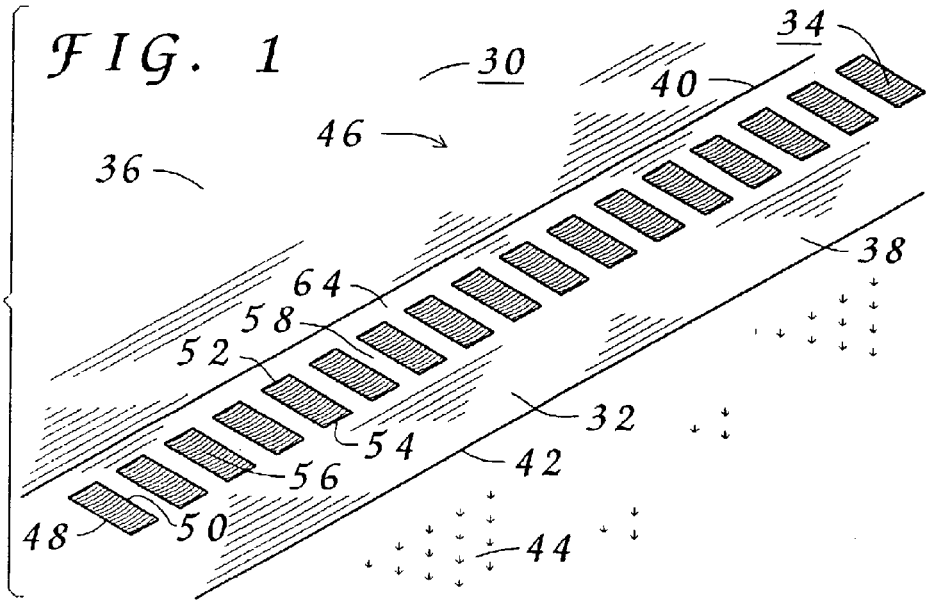
FIG. 1 is a perspective view of a continuous series of depression installed in a road.

Reference is now made to the drawings where like reference numerals refer to like parts throughout the various views.

Depression installation machines having features of the present invention may be used to install a continuous series of depressions or a series of depressions with a skip pattern therein. A skip pattern series will have a repetitive combination of a length of the surface of the roadway which have the depressions installed therein and a length of the surface of the roadway which do not have the depressions installed therein. Normally the length of the surface of the roadway which have the depressions installed therein of each combination will have a plurality of depression installed therein while the length of the surface of the roadway which do not have the depressions installed therein of each combination will be sufficient to have a plurality of the installed depressions installed therein.

Preferably, the repeating pattern of a specific skip pattern will be installed during a single cycle of the camming surface, whether on a camming wheel, a camming track or some other suitable cam carrier. As an example, the depressions installed during each rotation of the cam wheel further comprises a series of generally uniformly spaced depressions and a segment of untreated surface of the roadway with the segment of untreated surface of the roadway generally equal to a multiple of a spacing between adjacent installed depressions. As a more narrow example the skip pattern may have eight depressions installed therein and a length of the surface of the roadway which does not have the depressions installed therein of each combination sufficient to have four of the installed depressions installed therein. This results in a complete cycle of the camming surface during movement along the surface of the roadway equal to a center to center spacing of adjacent installed depressions multiplied by twelve, the number of installation positions within each repetitive group of the skip pattern.

Figure 2:
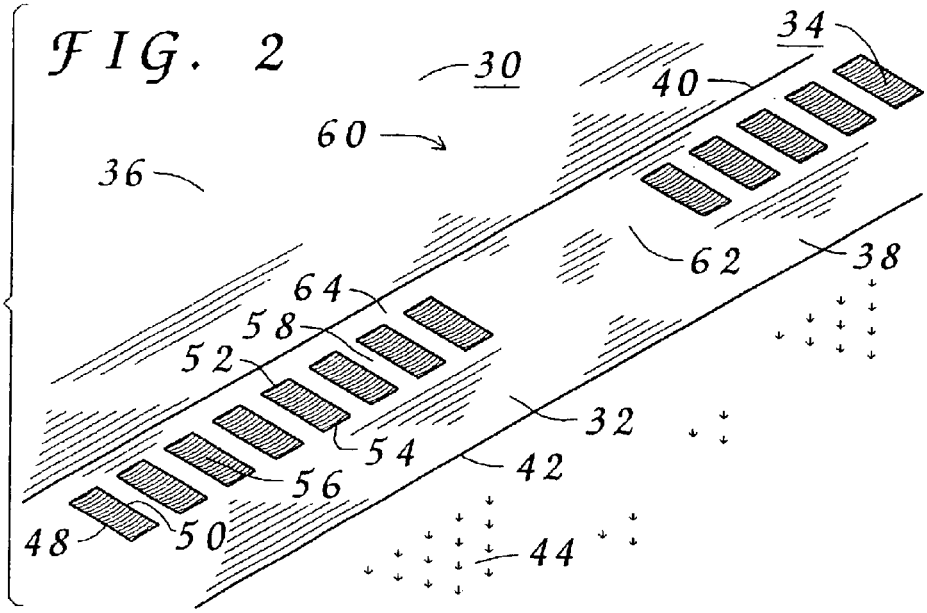
FIG. 2 is a perspective view of a skip pattern series of depressions installed in the road.

FIG. 1 and FIG. 2 depict installations of two series of depressions 34 into a surface 64. FIG. 1 depicts an installation of a continuous series 46 along a roadway 30, formed of a material 32, and separated into two distinct areas by a side marking line 40. These two areas are a driving surface 36 and an extended edge 38. Roadway 30 is separated from a shoulder 44 by an edge of pavement 42. Extended edge 38 has installed in surface 64 a series of seventeen, (17), depressions 34 in FIG. 1 while FIG. 2 has installed in surface 64 thirteen, (13), depressions 34. Depressions 34 may be installed in any desired position of roadway 30. Each depression 34 has a first edge 48 and a second edge 50. Edges 48 and 50 are relatively perpendicular to edge of pavement 42 and each is transitional, gradually sloping into depression 34. Each depression 34 further has a first side 52 and a second side 54. Sides 52 and 54 are relatively parallel to edge of pavement 42. Each depression 34 has a center of cut 56 which extends from first side 52 to second side 54 and is of a relatively even depth measured from the plane formed by the surrounding material 32. The shading depicted within each depression 34 is for illustrative purposes to depict the curved shape. A separating strip 58 separates each adjacent set of depressions 34. Separating strip 58 is an area of uncut material 32.

The example SNAP depressions 34 have a length, measured from second edge 50 to first edge 48 of approximately seven inches. A width, measured from first side 52 to second side 54 of approximately sixteen inches and a depth of approximately one half inch. Approximately five inches of uncut material 32 separate each adjacent set of depressions, with the exception of a skip pattern 62 shown in FIG. 2. Therefore, approximately twelve inches, measured from center to center, separate each adjacent set of depressions 34 in a continuous series. Continuous series 46 illustrated in FIG. 1 requires approximately fifty-two hundred and eighty cuts per mile of installation.

FIG. 2 depicts an installation of a skip pattern series 60 of depressions 34 having skip pattern 62 incorporated therein along roadway 30. Rather than continuous installation, elimination of a predetermined group of cuts occurs during installation. The example illustrated produces eight installations followed by the elimination of installation of four in a repetitive loop. Skip pattern series 60 illustrated in FIG. 2 requires approximately thirty-five hundred and twenty cuts per mile of installation.

In use the installation machine, including the rotary cutting tool, is advanced along the surface of the roadway while the elevational displacement of the rotary cutting tool is repetitively performed wherein the rotary cutting tool is alternatingly displaced downward into contact with the surface of the roadway and displaced upward out of contact with the surface of the roadway to successively install the series of depressions in the surface of the roadway. While near plunge cuts are possible it is preferred to have the milling occur where significant forward movement of the rotary cutting tool occurs during the decent into the roadway and during the ascent out of the roadway. This results in a mill through cut where the radius of the resultant depression is greater than the radius of the rotary cutting tool.

Various types of cutting tools, having various cutting elements, are known in the art to mill asphalt and concrete and many of these may be used with the present invention. A rotary cutting tool for milling the surface of the roadway will have a cutting width matching the desired resultant depression. Many different power sources are known in the art to rotate applicable rotary cutting tools and many of these may be utilized with the present invention.

Figure 3A:
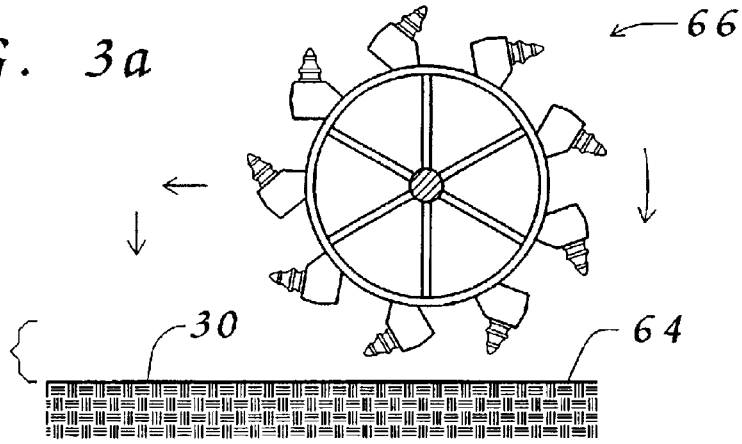
FIG. 3*a* through FIG. 3*c* are elevational depictions of a rotary cutting tool forming a depression.
Figure 3B:
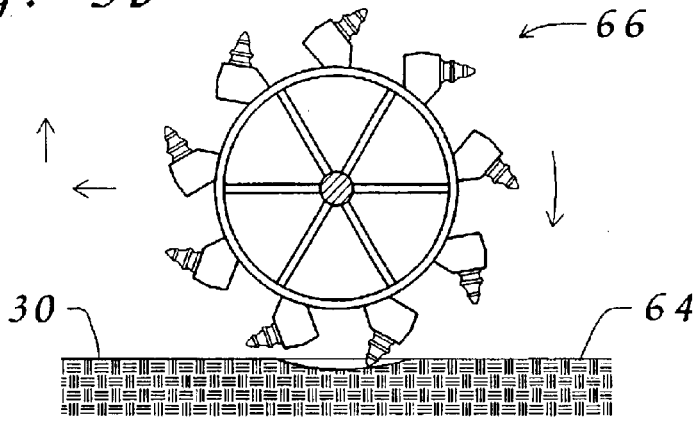
Figure 3C:
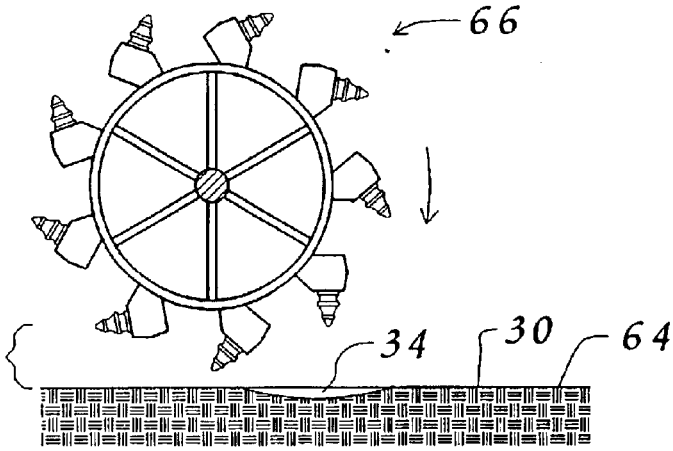

FIG. 3*a* through FIG. 3*c* depict a rotary cutting tool 66 continuously moving forward along surface 64 of roadway 30 during a depression installation process of the present invention. Rotary cutting tool is rotated at a high rate of speed in a clockwise direction during the entire depression installation process. During the forward advance of rotary cutting tool 66 depicted from FIG. 3*a* to FIG. 3*b* rotary cutting tool 66 is lowered based on principles of the present invention wherein a milling action occurs along the length of rotary cutting tool 66. During the continued forward advance of rotary cutting tool 66 depicted from FIG. 3*b* to FIG. 3*c* rotary cutting tool 66 is raised based on principles of the present invention where the milling action ends when rotary cutting tool 66 leaves contact with surface 64. During the continuous forward advance of rotary cutting tool 66 depicted in these views rotary cutting tool was lowered into contact with and below surface 64 and raised out of contact with surface 64 to form depression 34, see FIG. 3*c*. It being noted that significant forward advance of rotary cutting tool 66 occurred while in contact with roadway 30 both during the lowering action and the raising action. This produced a mill through cut to form depression 34.

A camming surface will be provided capable of having a follower member move thereover during movement of the camming surface. The camming surface will move in an endless loop in response to movement of the installation machine along the surface of the roadway. Preferably the cam carrier upon which the camming surface is located will be in direct contact with the surface of the roadway. In a preferred embodiment a cam wheel will have the camming surface thereabout where the cam wheel is generally round in cross section. While it is possible to provide for a single camming surface on the cam carrier preferably opposing camming surfaces will be positioned at or near opposing ends of the cam carrier each with a follower member tracking a respective camming surface. The follower member preferably will be of a bearing type and roll along the camming surface.

The camming surface will have a plurality of camming groups each corresponding to an installation location of the resultant depressions or of possible resultant depression locations within a skip portion of a skip pattern series. For camming groups corresponding to locations of intended installation depressions the camming group will have an elevational variation.

It is possible to provide a camming surface for a skip pattern installation wherein the camming groups corresponding to installed depression having the desired elevational changes and the camming groups corresponding to skipped installation have an elevational configuration wherein the rotary cutting tool remains elevated during passage of the follower member through those camming groups. More preferably each of the camming groups will have the desired elevational changes where each camming group is capable of regulating the rotary cutting tool for installation of a depression. Such camming surfaces being versatile enough to install a continuous series of depressions.

Blocking means provides for a blocking of transfer of the downward displacement of the rotary cutting tool into contact with the surface of the roadway for select portions of the camming surface. An insert, or inserts, may then be positioned relative to select camming group(s) where the follower member rides over a surface of the insert and the rotary cutting tool remains elevated above the surface of the roadway where that installation position is skipped. Most preferably the insert, or inserts, may be positioned relative to any desired camming group, or camming groups, where a rotation of the utilized camming groups may be made during sustained use of the camming surface for even uniform wear of the camming surface. It is possible to provide an insert which spans several camming groups or individual inserts for each camming group. When a twelve installation camming surface is utilized for an eight install and four skip pattern an outmost insert of the four adjacent inserts can be moved clockwise or counter clockwise at some standard interval, such as every certain number of miles of installation. Over the course of time this method ensures uniform wear of the camming surface and prolongs the life of the camming surface.

The follower member preferably will ride on the camming surface aligned with the closest approach of the camming surface to the surface of the roadway under treatment. It is possible to provide for the desired transfer of elevational control of the rotary cutting tool utilizing placement of the follower member at any select location on the camming surface.

It is also possible to provide for the camming surface to be segmented and formed of a plurality of sections which are attached to a cam carrier, such as a cam wheel, to cooperate in forming the camming surface. This provides for ready modification of the installation machine to match any desired configuration of depressions including width and depth and spacing within the overall limitations of the circumference of the cam carrier. Many suitable securement methods are known in the art and many of these can be utilized to mount the segmented camming surface to the cam carrier or to mount the inserts relative to the camming groups of the camming surface.

While a round cam wheel is preferred it is possible to provide for the camming surface to be positioned on a camming track. A camming track is particularly desirable where the installation machine will be used to install skip patterns having various configurations including those which alter the overall travel distance along the roadway of the repeating pattern. It is possible to configure an installation machine which will accept tracks of various circumferential lengths by adding sections to the track and providing a variable take-up location.

Some mechanical linkage will be provided to transfer the elevational displacement of the follower member during movement along the camming surface to the rotary cutting tool. Many methods are known in the art to provide such linking means and many of these may be utilized with the present invention. The linkage means provides for transfer of the elevational changes of the follower member relative to the camming surface to the rotary cutting tool. This provides for the rotary cutting tool to be alternatingly displaced downward into contact with the surface of the roadway and displaced upward out of contact with the surface of the roadway to successively install the series of depressions in the surface of the roadway.

Ideally the rotary cutting tool will be pivoted relative to a pivotal axis which moves along at a stable elevation relative to the surface of the roadway under treatment. In a preferred embodiment wheels are provided on the opposing side of the rotary cutting tool from the camming surface for the purpose. Depending upon the placement and the spacing of the various components it is possible to transfer a smaller, an equal or a greater amount of elevational displacement to the rotary cutting tool than that experienced by the follower member during passage over the camming surface. Alternatively at least three camming surfaces may be employed about the rotary cutting tool to operate in a synchronized manner to carry the rotary cutting tool where the entire rotary cutting tool assembly is lowered and raised rather than pivoted from a support axis. When such a configuration is provided each of the camming surfaces may provide for identical range of elevational motion or any select combination of ranges of elevational motion may be provided.

Figure 4:
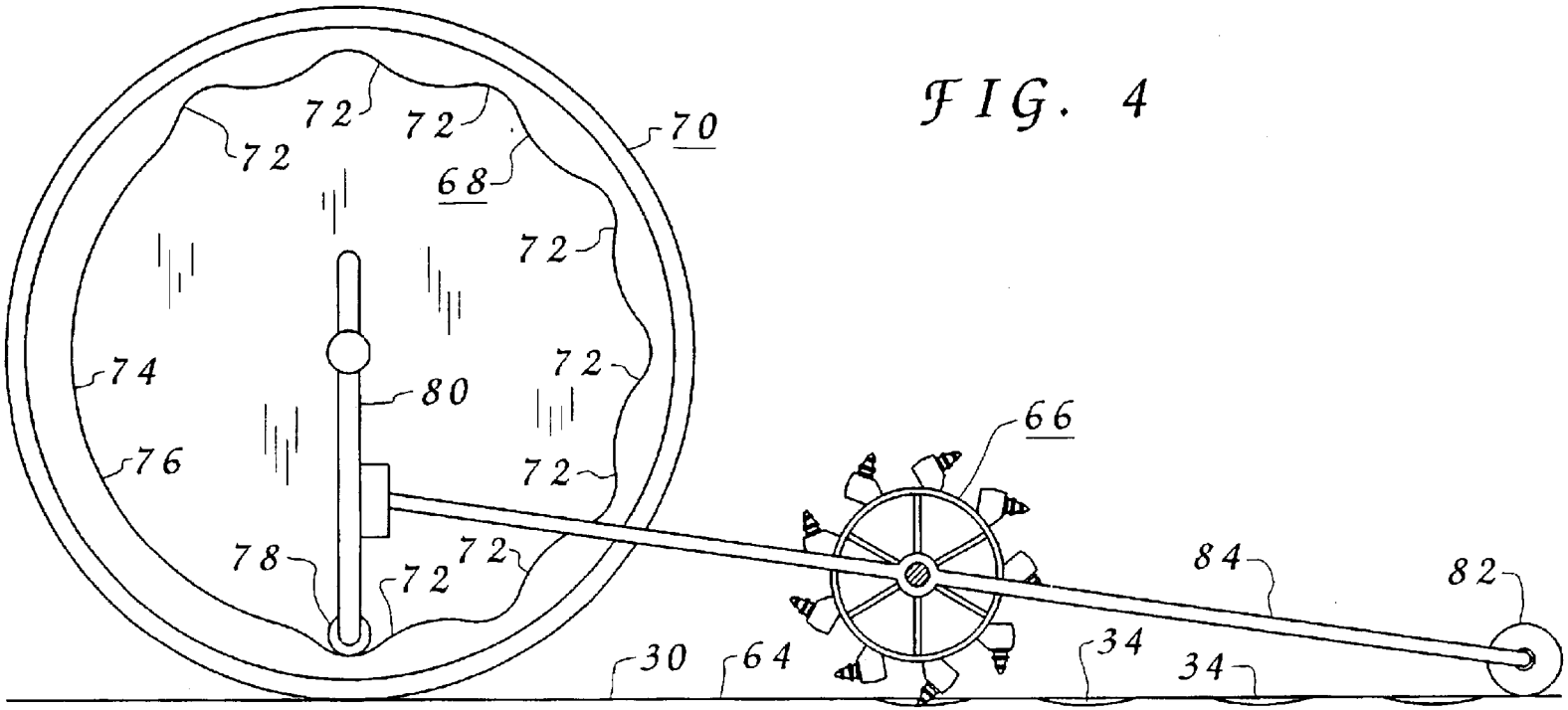
FIG. 4 is an elevational depiction of a camming surface on a cam wheel regulating a rotary cutting tool during formation of a skip pattern series of depressions.
Figure 5:
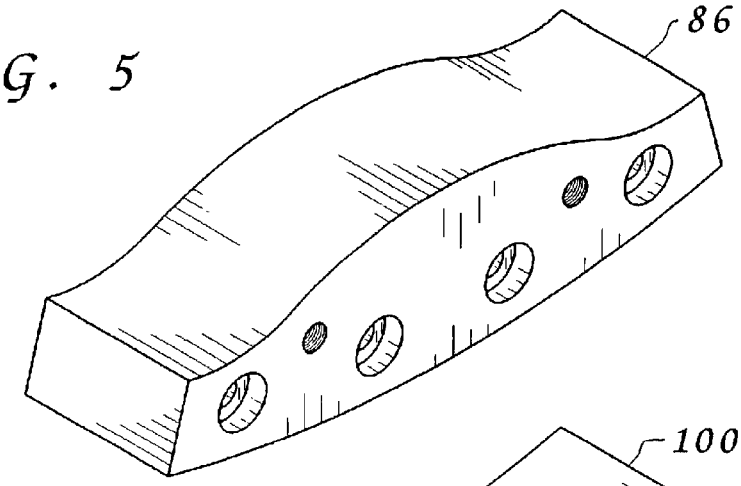
FIG. 5 is a perspective view of a section of a segmented camming surface.
Figure 6A:
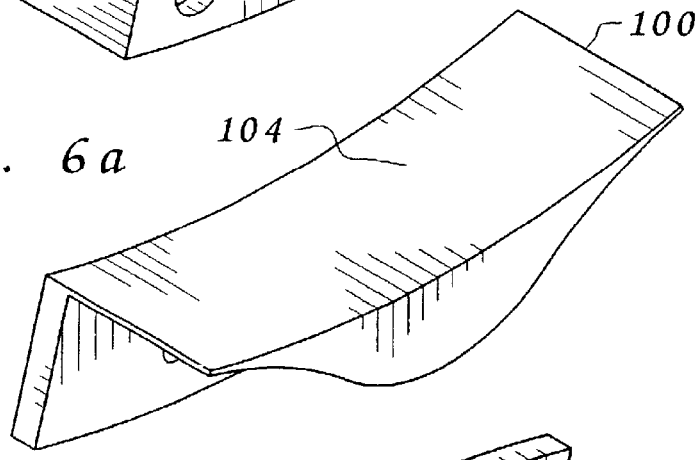
FIG. 6*a* and FIG. 6*b* are rear perspective views of a blocking member.
Figure 6B:
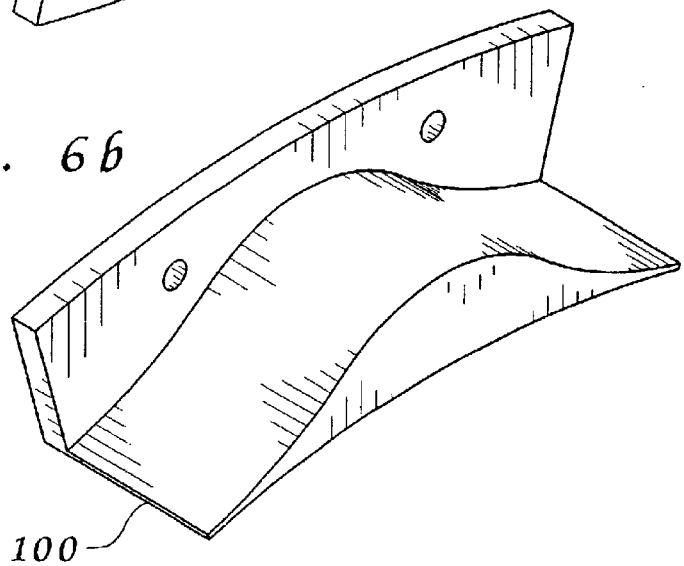

FIG. 4 depicts a camming surface 68 positioned on a cam wheel 70. Camming surface 68 moves in an endless loop during a depression installation process. Preferably cam wheel 70 has a similar camming surface 68 positioned on the opposing end. Camming surface 68 has eight (8) camming groups 72 with each having a surface elevational configuration to provide elevational changes to provide for regulation of elevational movement of rotary cutting tool 66. Cam wheel 70 has a circumference suitable to provide for twelve (12) such camming groups 72 while retaining a uniform elevation 74 through the positional placement location of four (4) of such camming groups 72 along camming surface 68. Uniform elevation 74 provides for a skip portion 76 of camming surface 68.

A follower member 78 is retained by a regulation member 80 to maintain a generally vertical orientation relative to cam wheel 70. A support wheel 82 is positioned to roll along surface 64 of roadway 30 beyond the range of depressions 34 installed in surface 64. A coupling member 84 extends from support wheel 82 to regulation member 80. Rotary cutting tool 66 is supported by coupling member 84 and moves down and up dependent upon elevational displacement of regulation member 80. Preferably another coupling member 84 is positioned on the opposing side of rotary cutting tool 66 and is attached to another regulation member 80 which is elevational displaced by movement of another follower member 78 moving along another camming surface 68 of cam wheel 70.

During use cam wheel 70 rolls along surface 64 of roadway 30 and follower member 78 moves along camming surface 68 to bias regulation member 80 through camming groups 72 and skip portion 76. Such movement through each complete rotation of cam wheel 70 causing coupling member 84 to not only move rotary cutting tool 66 forward along roadway 30 but also to repetitively be elevational displaced downward into contact with surface 64 and upward out of contact with surface 64 to form one (1) depression 34 for each camming group 72. During the portion of the complete rotation of cam wheel 70 through skip portion 76 rotary cutting tool 66 is retained above surface 64 thus skipping installation of depressions in surface 64 corresponding to such travel.

The machine described for FIG. 4, during prolonged rotation along surface 64 of roadway 30, would thus install skip pattern series 60 shown in FIG. 2. A suitable camming surface could be provided on a cam carrier, such as a cam wheel, to match nearly any specification for installation of depressions of either a continuous type or skip pattern type.

Referring now to FIG. 5 and FIG. 7*a* through FIG. 8*e*, a section 86 of a camming surface 88 is capable of being attached to a cam carrier 90, utilizing recessed bolts 91. When a plurality, twelve (12) in this example, of sections 86 are properly positioned camming surface 88 is formed in a segmented manner. Camming surface 88 moves in an endless loop during a depression installation process. Cam carrier 90, a cam wheel, is capable of moving along surface 64 of roadway 30 while follower member 78 moves along camming surface 88 and provides elevational control of a regulation member 92. Coupling member 84 transfers elevational displacement to rotary cutting tool 66 for selectively mill surface 64 of roadway 30 to form depressions 34 therein.

Figure 8A:
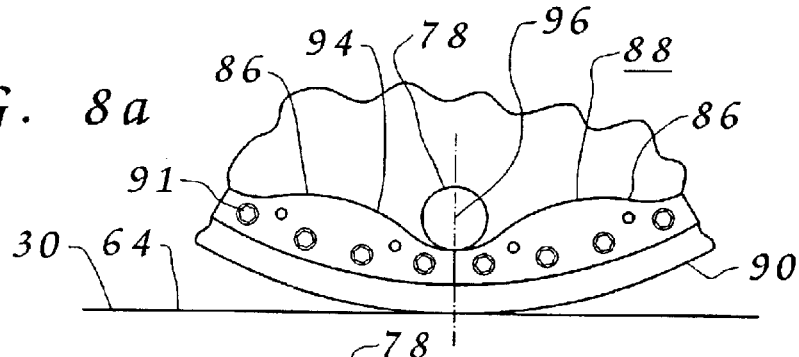
FIG. 8*a* through FIG. 8*e* are elevational depictions of a portion of the cam wheel shown in FIG. 7*a* and FIG. 7*b* in various operational orientations.
Figure 8B:
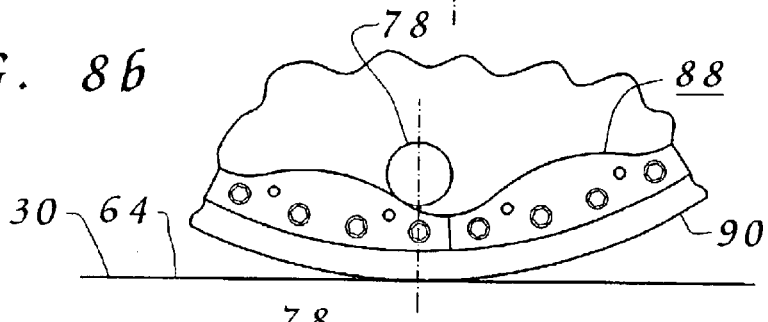
Figure 8C:
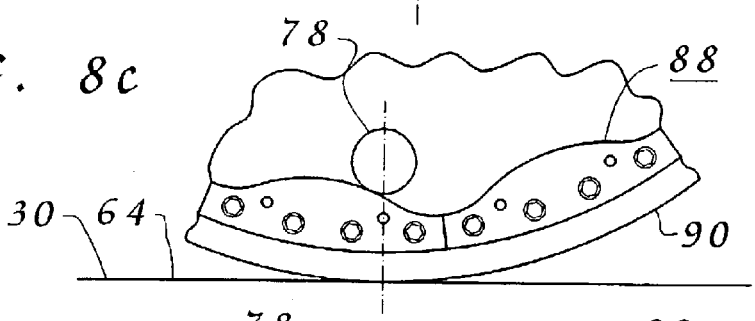
Figure 8D:
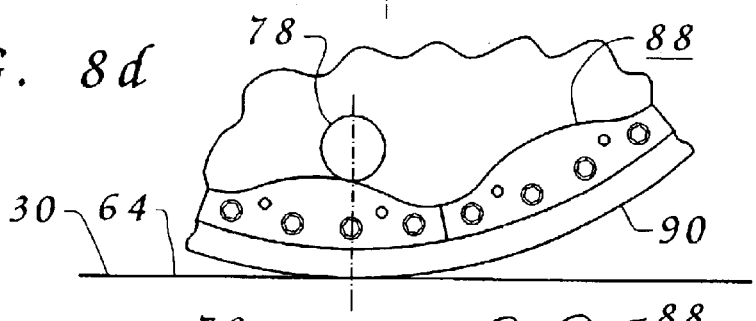
Figure 8E:
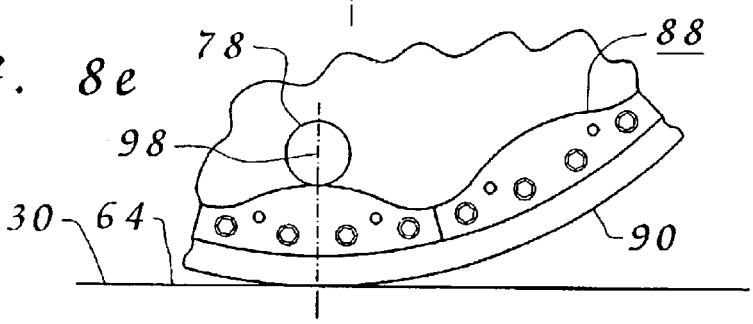

FIG. 8*a* through FIG. 8*e* depict movement through one half of a camming group 94 wherein follower member 78 is displaced from a lowest elevation 96, see FIG. 8*a*, to a highest elevation 98, see FIG. 8*e*. During this elevational change follower member 78 has advanced along surface 64 of roadway 30 one half of a center to center spacing between adjacent installed depressions, not shown in these views. Depending upon the elevational movement transfer configuration deployed the rotary cutting tool, not shown in these views, could have been elevated above surface 64 of roadway 30 when follower member 78 was at lowest elevation 96 or, more preferably, could have been at its lowest elevational position. Similarly the rotary cutting tool could have been at its lowest elevation position relative to surface 64 of roadway 30 when follower member 78 was at highest elevation 98 or, more preferably, could have been at its highest elevational position.

Figure 7A:
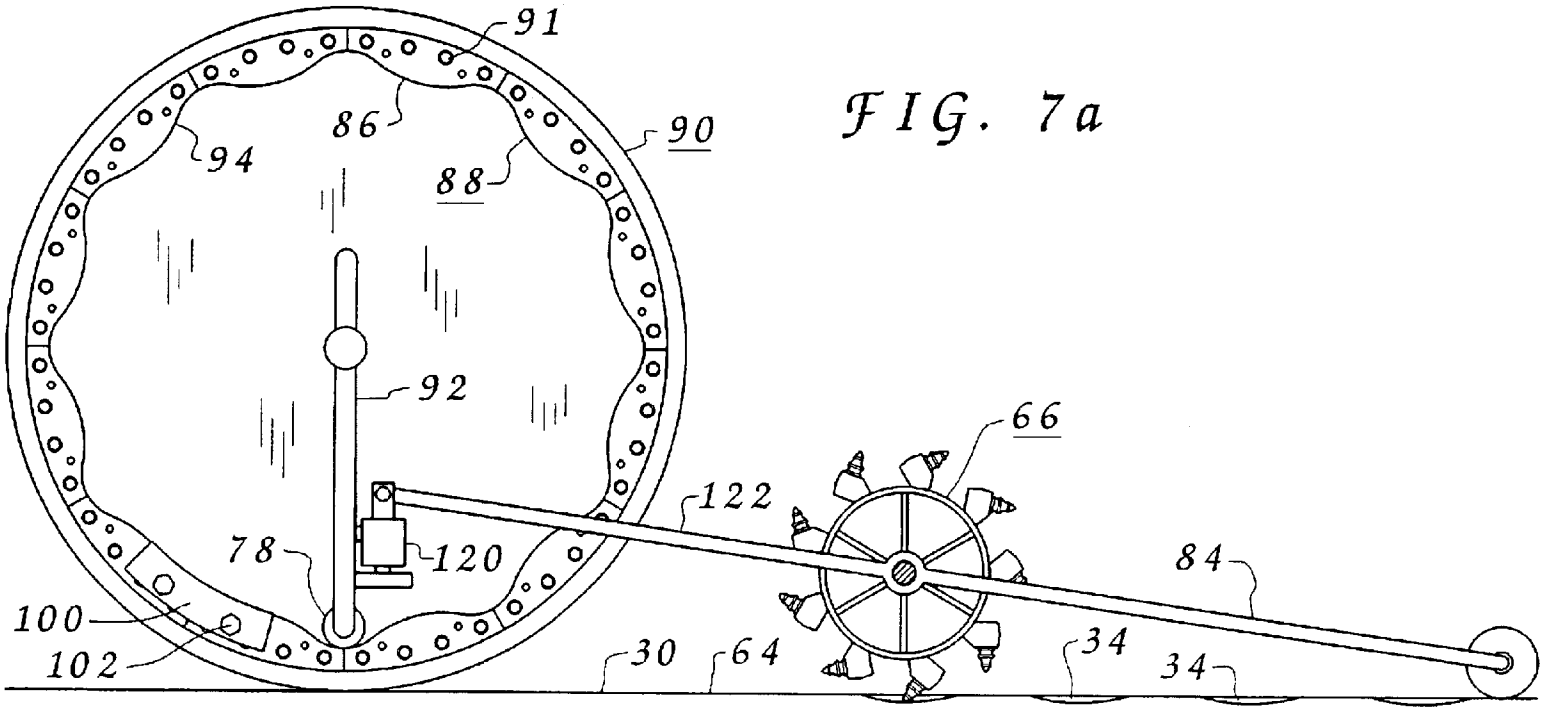
FIG. 7*a* and FIG. 7*b* are elevational depictions of a camming surface formed of the sections depicted in FIG. 5 and the blocking member shown in FIG. 6*a* and FIG. 6*b* and mounted on a cam wheel regulating a rotary cutting tool during formations of a skip pattern series of depressions.
Figure 7B:
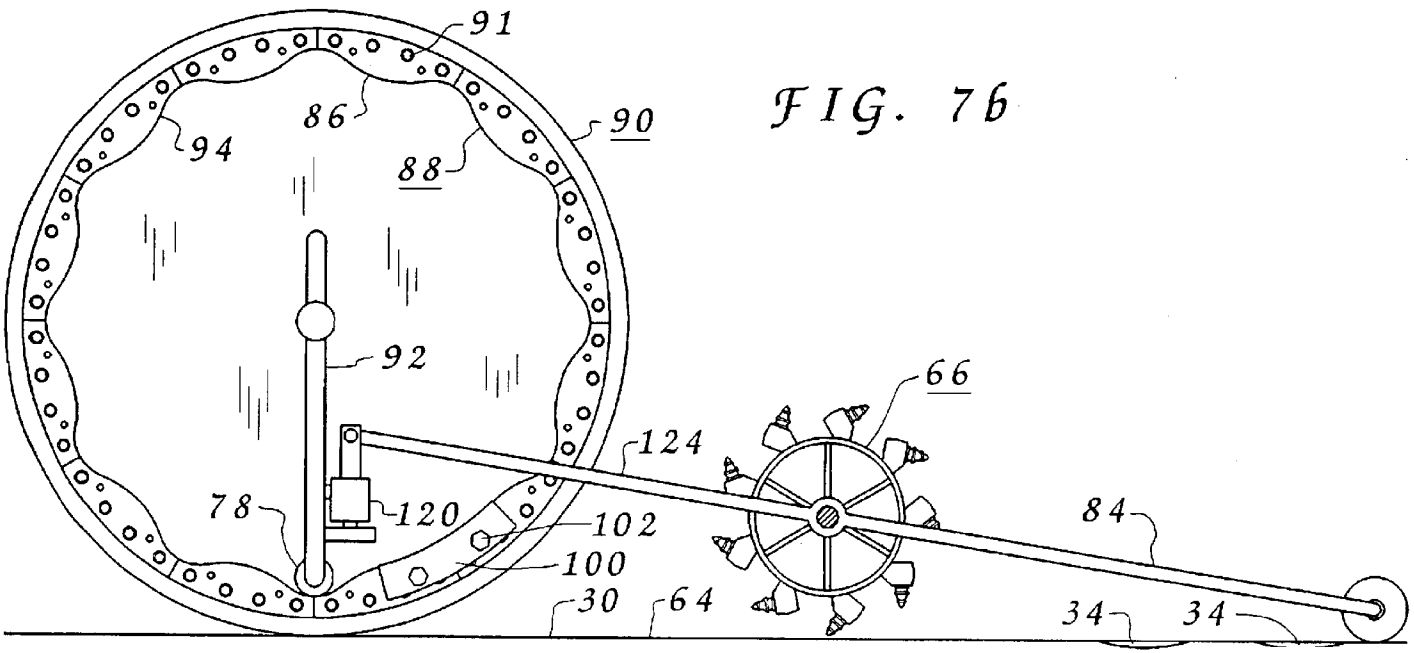

Referring now to FIG. 6*a* and FIG. 6*b* and FIG. 7*a* and FIG. 7*b*, an insert 100 is capable of being attached to sections 86 of camming surface 88, utilizing bolts 102. Follower member 78 will then roll over a surface 104 of insert 100 rather than follow camming surface 88. This prevents follower member 78 from having the radical elevational changes associated with camming surface 88. Thus it is possible to prevent transfer of certain elevational changes from follower member 78 to rotary cutting tool 66. Any select number of inserts 100 may be deployed to block certain camming groups 94 or portions thereof. Cam carrier 90 has twelve (12) camming groups 94 so when an install eight (8)— skip four (4) pattern is desired four (4) inserts 100 may be adjacently attached to sections 86. Due to wear occurring over a prolonged usage period between camming surface 88 and follower member 78 routine rotation of placement of inserts 100 may occur to ensure uniform wear of camming surface 88. FIG. 7*a* and FIG. 7*b* only depict installation of one (1) insert 100 with secondary blocking described below.

Figure 9A:
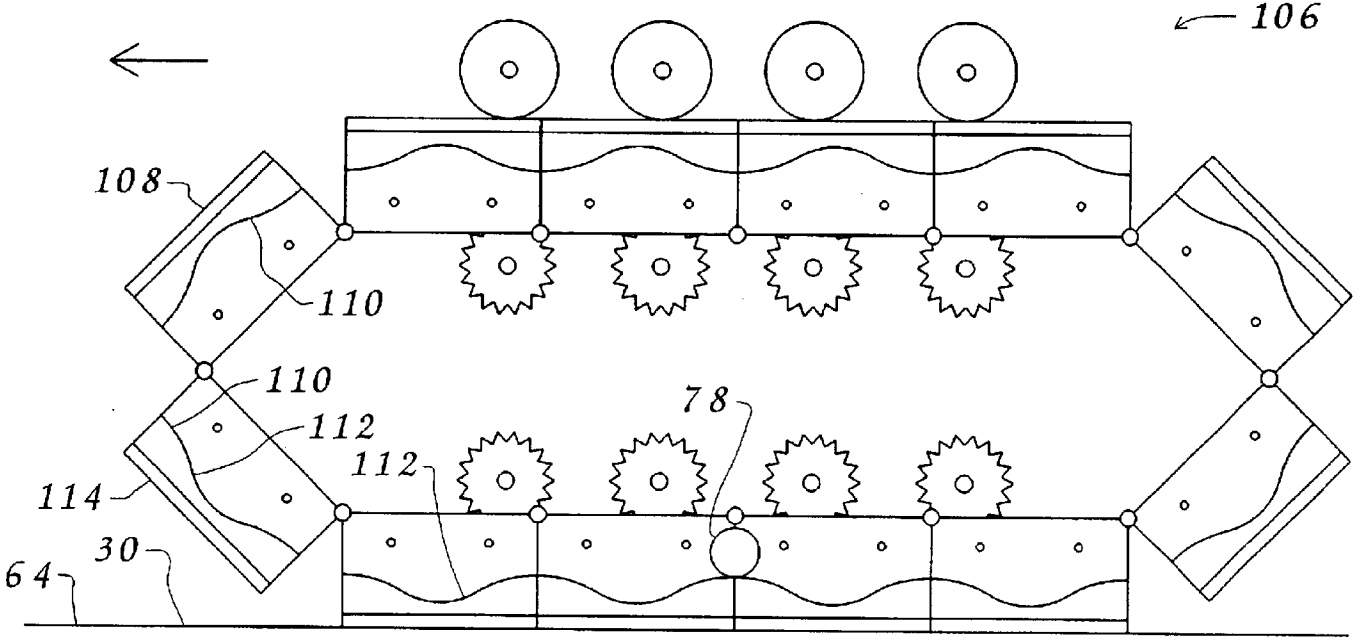
FIG. 9*a* and FIG. 9*b* are elevational depictions of a cam track.
Figure 9B:
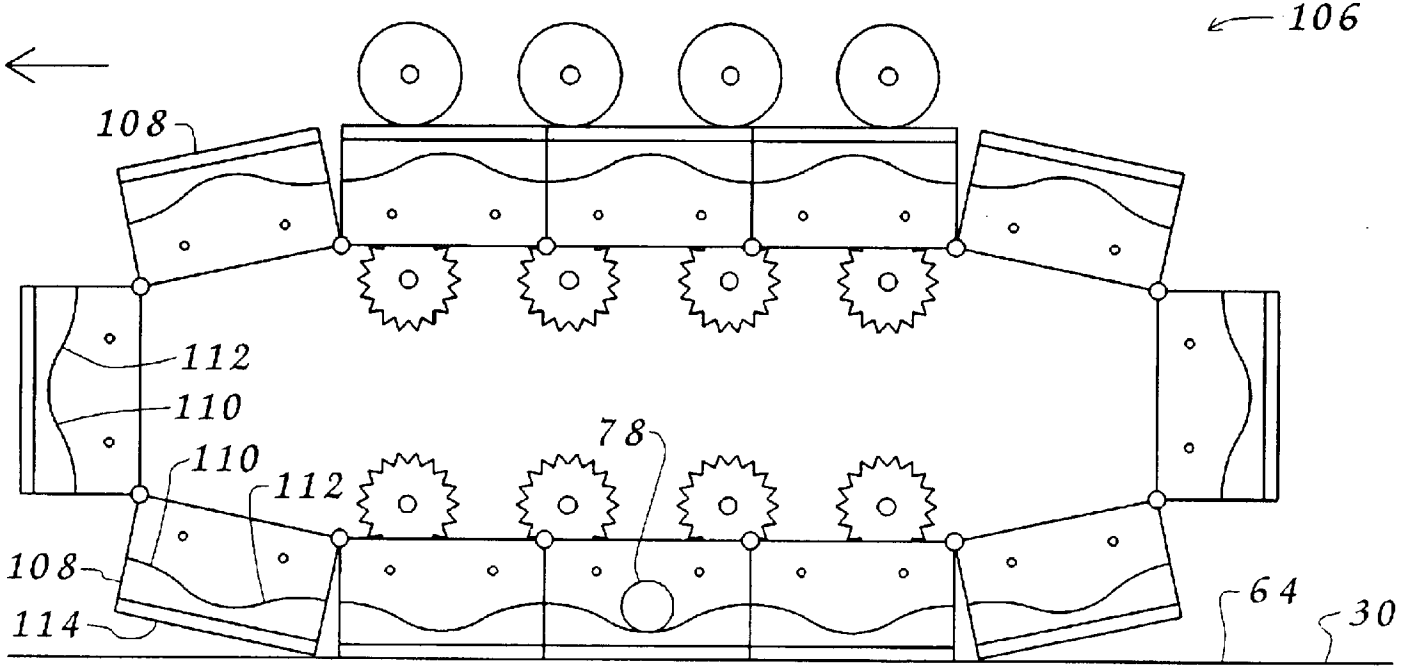
Figure 9C:
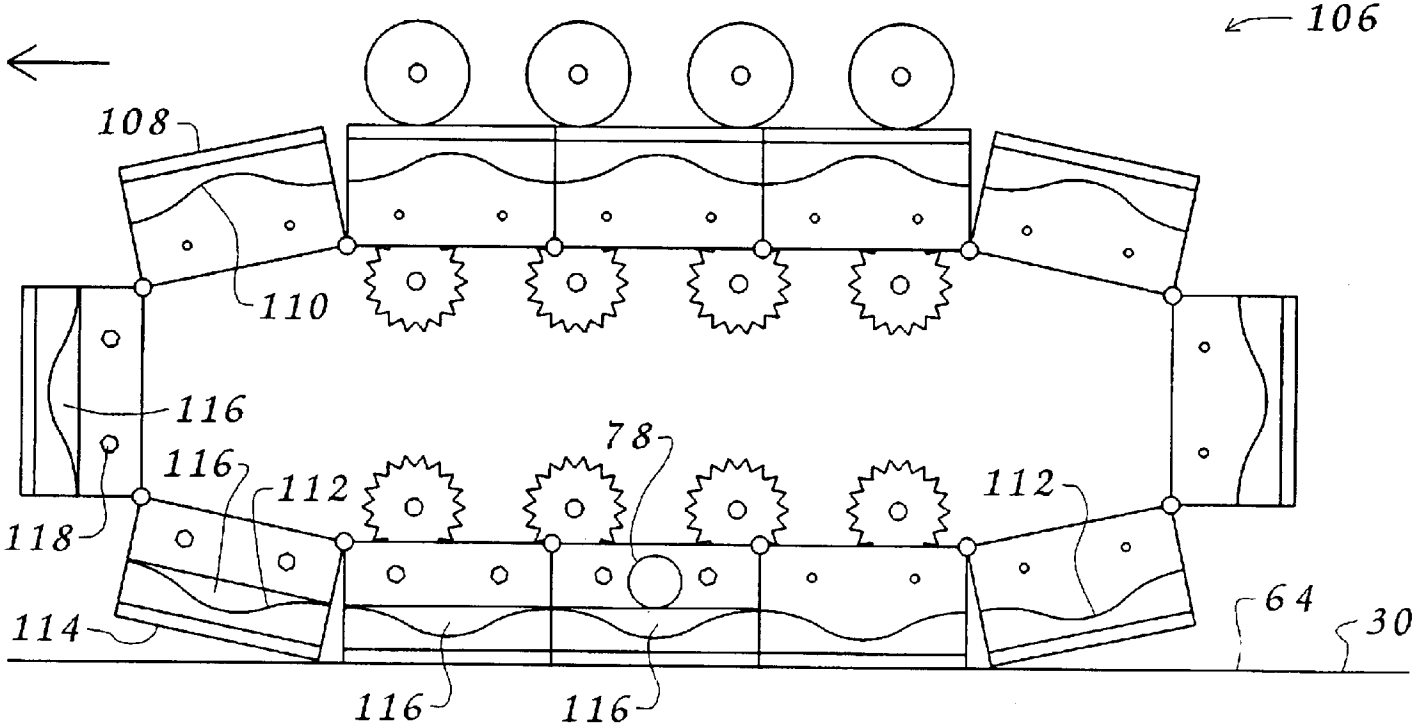
FIG. 9*c* is an elevational depiction of the cam track shown in FIG. 9*a* and FIG. 9*b* with four (4) blocking members installed thereon.

FIG. 9*a* through FIG. 9*c* depict a cam carrier 106, in the form of a cam track, for movement along surface 64 of roadway 30. Tracks are well known in the art, including mounting and rotation means and many of these methods may be employed with the present invention. A plurality of sections 108 are provided having a camming group 110 of a camming surface 112 positioned thereon. Camming surface 112 moves in an endless loop during movement of cam carrier 106 along roadway 30. Preferably opposing camming surfaces 112 are deployed wherein opposing follower members 78 regulate movement of a rotary cutting tool, not shown in these views.

Means are provided to retain follower member 78 longitudinally fixed relative to cam carrier 106. A particularly desirable feature of such cam tracks is that any wear to a ground contact surface 114 during prolonged usage will not effect longitudinal spacing of installed depressions but rather only require minor elevational adjustment to the cutting action. Therefore, if a twelve (12) inch center to center spacing is desired between adjacent installed depressions excessive wear to ground contact surface 114 will have no effect upon this spacing.

FIG. 9*c* depicts four (4) inserts 116 attached to four (4) respective sections 108 utilizing bolts 118. Inserts 116 alter the elevational movement of follower member 78 to selectively prevent installation of depressions during movement of follower member 78 relative to that respective camming group 110. Cam carrier 106 has twelve (12) camming groups 110 so the adjacently installed four (4) inserts 116 will produce an eight (8) install and four (4) skip pattern.

When an insert, or inserts, are used to provide for the elimination of transfer of the cutting displacement of the rotary cutting tool for a camming group, or camming groups, it is possible to provide secondary blocking means to retain the rotary cutting tool above the surface of the roadway. Secondary blocking means provides for elevating the rotary cutting tool above the surface of the roadway during a movement of the follower member through select camming groups of the camming surface. This ensures that the insert, which may move the follower member to a greater elevational variation than that of standard camming groups, does not exert undue pressure upon the follower member or other structural components. Such secondary blocking may take many forms with a preferred method being a hydraulic drive, or drives, which mechanically manipulate the rotary cutting tool. This arrangement may also be used where a plurality of installations associated with sequential camming groups are to be skipped and an insert is utilized only for the first camming group to be skipped. In this example the camming group blocking means in the form of an insert operates only on a first skip position of the length of the surface of the roadway which does not have the depressions installed therein of each combination of the installed depressions. In this arrangement the secondary blocking will be relied upon to prevent transfer of the elevational movement of the rotary cutting tool during passage of the follower member through the subsequent camming groups.

FIG. 7*a* and FIG. 7*b* depict secondary blocking means in the form of a hydraulic drive 120 positioned between regulation member 92 and coupling member 84. When coupling member 84 is in a standard position 122, see FIG. 7*a*, relative to regulation member 92 each camming group 94 of camming surface 88 may be transferred to rotary cutting tool 66 to mill a respective depression 34. When follower member 78 encounters surface 104 of insert 100 rotary cutting tool 66 remains elevated above surface 64 of roadway 30. During passage of follower member 78 over insert 100 hydraulic drive 120 is activated and coupling member 84 is transferred to an elevated position 124, see FIG. 7*b*, relative to regulation member 92. When follower member 78 passes insert 100 and returns to camming surface 88 proper and camming groups 94 are again encountered hydraulic drive 120 prevents rotary cutting tool 66 from contacting surface 64 of roadway 30. Following passage of a predetermined number of camming groups 94 hydraulic drive 120 returns coupling member 84 to standard position 122 relative to regulation member 92 and installation of subsequent depressions 34 may occur. This method provides for installation of skip pattern series of depressions.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of installing a series of depressions in a surface of a roadway, the method comprising the steps of;

a) providing a rotary cutting tool capable of milling into the surface of the roadway;

b) providing a camming surface moveable in an endless loop in response to movement relative to the surface of the roadway, the camming surface having a plurality of camming groups, each camming group having a surface elevational configuration and wherein the provided camming surface is positioned on a provided cam wheel and wherein the cam wheel rolls along the surface of the roadway during the moving of the rotary cutting tool along the surface of the roadway;

c) providing a follower member to track the camming surface, the follower member having an elevational displacement corresponding to movement relative to the surface elevational configuration of at least select camming groups of the camming surface;

d) providing linking means to provide for a transfer of the elevational displacement of the follower member to an elevational displacement of the rotary cutting tool;

e) moving the rotary cutting tool along the surface of the roadway while the elevational displacement of the rotary cutting tool is repetitively performed wherein the rotary cutting tool is alternatingly displaced downward into contact with the surface of the roadway and displaced upward out of contact with the surface of the roadway to successively install the series of depressions in the surface of the roadway.

2. A method of installing a series of depressions in a surface of a roadway, the method comprising the steps of;

a) providing a rotary cutting tool capable of milling into the surface of the roadway;

b) providing a camming surface moveable in an endless loop in response to movement relative to the surface of the roadway, the camming surface having a plurality of camming groups, each camming group having a surface elevational configuration and wherein the provided camming surface is positioned on a provided cam track and wherein the cam track moves along the surface of the roadway in contact with the surface of the roadway during the moving of the rotary cutting tool along the surface of the roadway;

c) providing a follower member to track the camming surface, the follower member having an elevational displacement corresponding to movement relative to the surface elevational configuration of at least select camming groups of the camming surface;

d) providing linking means to provide for a transfer of the elevational displacement of the follower member to an elevational displacement of the rotary cutting tool;

e) moving the rotary cutting tool along the surface of the roadway while the elevational displacement of the rotary cutting tool is repetitively performed wherein the rotary cutting tool is alternatingly displaced downward into contact with the surface of the roadway and displaced upward out of contact with the surface of the roadway to successively install the series of depressions in the surface of the roadway.

3. A method of installing a series of depressions in a surface of a roadway, the method comprising the steps of;

a) providing a rotary cutting tool capable of milling into the surface of the roadway;

b) providing a camming surface moveable in an endless loop in response to movement relative to the surface of the roadway, the camming surface having a plurality of camming groups, each camming group having a surface elevational configuration;

c) providing a follower member to track the camming surface, the follower member having an elevational displacement corresponding to movement relative to the surface elevational configuration of at least select camming groups of the camming surface;

d) providing linking means to provide for a transfer of the elevational displacement of the follower member to an elevational displacement of the rotary cutting tool;

e) moving the rotary cutting tool along the surface of the roadway while the elevational displacement of the rotary cutting tool is repetitively performed wherein the rotary cutting tool is alternatingly displaced downward into contact with the surface of the roadway and displaced upward out of contact with the surface of the roadway to successively install the series of depressions in the surface of the roadway;

f) providing blocking means to provide for selectively elevating the rotary cutting tool above the surface of the roadway during movement of the follower member through select camming groups of the camming surface and wherein the provided blocking means further comprises a removeable insert positioned relative to the camming surface wherein the follower member moves over the removeable insert during movement through a respective camming group.

4. A method of installing a series of depressions in a surface of a roadway, the method comprising the steps of:

a) providing a rotary cutting tool capable of milling into the surface of the roadway;

b) providing a camming surface moveable in an endless loop in response to movement relative to the surface of the roadway, the camming surface having a plurality of camming groups, each camming group having a surface elevational configuration;

c) providing a follower member to track the camming surface, the follower member having an elevational displacement corresponding to movement relative to the surface elevational configuration of at least select camming groups of the camming surface;

d) providing linking means to provide for a transfer of the elevational displacement of the follower member to an elevational displacement of the rotary cutting tool;

e) moving the rotary cutting tool along the surface of the roadway while the elevational displacement of the rotary cutting tool is repetitively performed wherein the rotary cutting tool is alternatively displaced downward into contact with the surface of the roadway and displaced upward out of contact with the surface of the roadway to successively install the series of depressions in the surface of the roadway;

f) providing blocking means to provide for selectively elevating the rotary cutting tool above the surface of the roadway during movement of the follower member through select camming groups of the camming surface and wherein the provided blocking means further comprises an insert fixedly positioned relative to the camming surface wherein the follower member moves over the insert during movement through a respective camming group.

5. A method of installing a series of depressions in a surface of a roadway, the method comprising the steps of:

a) providing a rotary cutting tool capable of milling into the surface of the roadway;

b) providing a cam wheel capable of rolling along the surface of the roadway, the cam wheel having a camming surface thereon moveable in an endless loop in response to the rolling of the cam wheel along the surface of the roadway, the camming surface having a plurality of camming groups;

c) providing a follower member to track the camming surface of the cam wheel, the follower member having an elevational displacement corresponding to movement relative to at least select camming groups of the camming surface of the cam wheel during each rotation of the cam wheel;

d) providing linking means to provide for a transfer of the elevational displacement of the follower member to an elevational displacement of the rotary cutting tool;

e) moving the rotary cutting tool and the cam wheel along the surface of the roadway while the elevational displacement of the rotary cutting tool is repetitively performed during each rotation of the cam wheel wherein the rotary cutting tool is alternatingly displaced downward into contact with the surface of the roadway and displaced upward out of contact with the surface of the roadway to successively install the series of depressions in the surface of the roadway during each rotation of the cam wheel;

f) providing blocking means to provide for blocking transfer of the downward displacement of the rotary cutting tool into contact with the surface of the roadway for select camming groups during each rotation of the cam wheel.

6. The method defined in claim 5 wherein the provided blocking means further comprises a removeable insert positioned relative to the camming surface wherein the follower member moves over the removeable insert during movement through a respective camming group.

7. The method defined in claim 5 further comprising providing securement means relative to each camming group and wherein the provided blocking means further comprises a removeable insert positioned relative to any select camming group utilizing the securement means wherein the follower member moves over the removeable insert during movement through a respective camming group.

8. The method defined in claim 5 wherein the provided camming surface is segmented into a plurality of sections with each of the sections of the camming surface attached to the provided cam wheel.

9. The method defined in claim 5 wherein the depressions installed during each rotation of the cam wheel further comprises a series of generally uniformly spaced depressions and a segment of untreated surface of the roadway, the segment of untreated surface of the roadway generally equal to a multiple of a spacing between adjacent installed depressions.

10. The method defined in claim 5 wherein the provided camming surface is segmented into a plurality of sections with each of the sections of the camming surface attached to the provided cam wheel and wherein the provided blocking means further comprises a removeable insert positioned relative to the camming surface wherein the follower member moves over the removeable insert during movement through a respective camming group.

11. A machine to install a series of depressions in a surface of a roadway, the series of depressions having a repetitive pattern having a combination of a length of the surface of the roadway which have the depressions installed therein and a length of the surface of the roadway which do not have the depressions installed therein, the length of the surface of the roadway which have the depressions installed therein of each combination having a plurality of depressions installed therein, the length of the surface of the roadway which do not have the depressions installed therein of each combination sufficient to have a plurality of the installed depressions installed therein, the machine comprising:

a) a rotary cutting tool for milling the surface of the roadway;

b) a cam wheel having a camming surface thereon moveable in an endless loop in response to a rolling of the cam wheel along the surface of the roadway, the camming surface having a plurality of camming groups;

c) a follower member to track the camming surface of the cam wheel, the follower member having an elevational displacement corresponding to movement relative to at least select camming groups of the camming surface of the cam wheel during each rotation of the cam wheel;

d) linking means to provide for a transfer of the elevational displacement of the follower member to an elevational displacement of the rotary cutting tool wherein the rotary cutting tool selectively is alternatingly displaced downward into contact with the surface of the roadway and displaced upward out of contact with the surface of the roadway to successively install the series of depressions in the surface of the roadway;

e) blocking means to provide for a blocking of the transfer of the downward displacement of the rotary cutting tool into contact with the surface of the roadway for select camming groups during each rotation of the cam wheel.

12. The machine defined in claim 11 further comprising secondary blocking means to provide for elevating the rotary cutting tool above the surface of the roadway during a movement of the follower member through select camming groups of the camming surface.

13. The machine defined in claim 12 wherein the blocking means operates only on a first skip position of the length of the surface of the roadway which do not have the depressions installed therein of each combination of the installed depressions.

14. The machine defined in claim 11 further comprising securement means relative to each camming group and wherein the blocking means further comprises a removeable insert positioned relative to any select camming group utilizing the securement means wherein the follower member moves over the removeable insert during movement through a respective camming group.

15. The machine defined in claim 11 wherein the plurality of depressions in each combination installed in the length of the surface of the roadway which have the depressions installed therein equals eight and wherein the length of the surface of the roadway which do not have the depressions installed therein of each combination equals four of the installed depressions.

* * * * *